US010439312B2

(12) United States Patent
Takane et al.

(10) Patent No.: US 10,439,312 B2
(45) Date of Patent: Oct. 8, 2019

(54) FLAT-CONDUCTOR CONNECTOR HAVING FLAT-CONDUCTOR RETAINING STRUCTURE IN HOUSING ITSELF

(71) Applicant: IRISO ELECTRONICS CO., LTD., Yokohama-shi, Kanagawa (JP)

(72) Inventors: Toru Takane, Yokohama (JP); Yoshihito Ohkuma, Yokohama (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/120,709

(22) Filed: Sep. 4, 2018

(65) Prior Publication Data

US 2019/0074619 A1 Mar. 7, 2019

(30) Foreign Application Priority Data

Sep. 4, 2017 (JP) ..... 2017-169180

(51) Int. Cl.
*H01R 12/79* (2011.01)
*H01R 13/627* (2006.01)
*H01R 12/77* (2011.01)

(52) U.S. Cl.
CPC ..... *H01R 12/79* (2013.01); *H01R 13/627* (2013.01); *H01R 12/774* (2013.01)

(58) Field of Classification Search
CPC ..... H01R 12/774
See application file for complete search history.

(56) References Cited

U.S. PATENT DOCUMENTS

| | | | | |
|---|---|---|---|---|
| 7,833,046 | B2 * | 11/2010 | Tamura | H01R 12/774 439/329 |
| 8,939,790 | B2 * | 1/2015 | Jung | H01R 12/774 439/495 |
| 9,401,554 | B2 * | 7/2016 | Takane | H01R 12/771 |
| 2016/0365658 | A1 | 12/2016 | Hikosaka | |

FOREIGN PATENT DOCUMENTS

| | | | |
|---|---|---|---|
| JP | S61-109083 | U | 7/1986 |
| JP | 2012-256483 | A | 12/2012 |
| JP | 2017-004858 | A | 1/2017 |
| JP | 2017-103095 | A | 6/2017 |

OTHER PUBLICATIONS

Office Action dated Sep. 25, 2018, by the Japanese Patent Office in corresponding Japanese Patent Application No. 2017-169180. (3 pages).

* cited by examiner

*Primary Examiner* — Tho D Ta
(74) *Attorney, Agent, or Firm* — Cermak Nakajima & McGowan LLP; Tomoko Nakajima

(57) ABSTRACT

To provide a flat-conductor connector that implements, with a simple structure, a function of preventing a flat conductor from coming out thereof.

A flat-conductor connector includes a housing including a holding portion into which a flat conductor is inserted to be electrically connected. The housing includes a deformation guiding portion that comes into contact with the flat conductor and that causes a side edge portion of the flat conductor to be curved and deformed in a thickness direction and a retaining engagement portion that is located on a far side of the deformation guiding portion in an insertion direction of the flat conductor and that engages an edge of a recess formed in the side edge portion of the flat conductor that has returned from a state of being curved and deformed to its original shape, in a direction in which the flat conductor is to be pulled.

5 Claims, 10 Drawing Sheets

FLAT-CONDUCTOR CONNECTOR HAVING FLAT-CONDUCTOR RETAINING STRUCTURE IN HOUSING ITSELF

BACKGROUND OF THE INVENTION

1. Field of the Invention

The present invention relates to a connector, and more particularly to a flat-conductor connector.

2. Description of the Related Art

A known example of connectors that are used in electronic devices is a connector that is mounted on a substrate and that electrically connects a flexible flat cable (FFC), a flexible printed circuit (FPC), or the like (that will be referred to as a flat conductor in the present specification and in the claims) to the substrate. Such connectors are mounted in numerous electronic devices because these connectors can connect internal units of devices such as computers and liquid crystal displays to substrates in various ways.

When a flat conductor and a substrate are electrically connected to each other, a locking member may sometimes be provided in order to prevent the flat conductor that has been inserted into a connector from accidentally coming out of the connector. For example, the electrical connector described in Japanese Unexamined Patent Application Publication No. 2012-256483 (FIG. 11, FIG. 13, FIG. 14, FIG. 15), which will hereinafter be referred to as Patent Document 1, is provided with locking members that are different members from a housing and each of which is formed by bending, for example, a thin-plate-shaped metal member.

The electrical connector described in Patent Document 1 has a configuration in which the locking members are elastically displaced when a flat conductor (a signal transmission medium), such as an FPC or an FFC, is inserted into the electrical connector and in which engagement positioning portions of the flat conductor are engaged with engagement locking portions of the locking members as a result of the flat conductor being inserted further deeply into the electrical connector, so that the flat conductor is prevented from coming out of the electrical connector. However, in the electrical connector described in Patent Document 1, it is necessary to provide the locking members, which are made of a metal and used for fixing the flat conductor inserted into the electrical connector, on the housing as separate members from the housing, and thus, the number of components and the number of assembly steps increase.

SUMMARY OF THE INVENTION

The present invention has been made against the background of the related art such as that described above, and it is an object of the present invention to provide a connector capable of implementing, with a simple structure, a function of preventing a flat conductor from coming out of the connector.

In order to achieve the above object, a flat-conductor connector according to the present invention has the following features.

That is to say, a flat-conductor connector according to the present invention includes a housing that includes a holding portion into which a flat conductor is inserted such that the flat conductor is electrically connected to the flat-conductor connector, and the housing includes a deformation guiding portion that is brought into contact with the flat conductor, which is inserted into the holding portion, and that causes a side edge portion of the flat conductor to be curved and deformed in a plate-thickness direction of the flat conductor and a retaining engagement portion that is located on a far side of the deformation guiding portion in an insertion direction of the flat conductor and that engages, in a direction in which the flat conductor is to be pulled, an engagement portion included in the side edge portion of the flat conductor, the side edge portion having returned from the state of being curved and deformed to an original shape of the side edge portion.

According to the present invention, by only inserting the flat conductor into the holding portion of the housing, the flat conductor can be prevented from coming out of the flat-conductor connector by the deformation guiding portion and the retaining engagement portion, which are included in the housing, and the use of a metal locking member as in the related art can be eliminated.

More specifically, the housing includes the deformation guiding portion that is brought into contact with the flat conductor, which is inserted into the holding portion, and that causes the side edge portion of the flat conductor to be curved and deformed in the plate-thickness direction of the flat conductor. In other words, according to the present invention, the flat-conductor connector allows the flat conductor to enter the holding portion by causing the flat conductor to be curved and deformed by using the deformation guiding portion of the housing instead of allowing the flat conductor to enter the housing by causing a locking member to be elastically displaced as in the related art. In addition, the housing according to the present invention includes the retaining engagement portion that is located on the far side of the deformation guiding portion in the insertion direction of the flat conductor and that engages, in a direction in which the flat conductor is to be pulled, the engagement portion included in the side edge portion of the flat conductor, the side edge portion having returned from a state of being curved and deformed to the original shape of the side edge portion. In other words, according to the present invention, instead of preventing the flat conductor from coming out of the flat-conductor connector by causing a locking member that has been elastically displaced to return to its original shape as in the related art, the flat conductor is prevented from coming out of the flat-conductor connector as a result of the engagement portion of the flat conductor that has returned from a state of being curved and deformed to its original shape being engaged with the retaining engagement portion of the housing. As described above, the flat-conductor connector according to the present invention, since the deformation guiding portion and the retaining engagement portion are included in the housing, a function of preventing the flat conductor from coming out of the flat-conductor connector can be implemented with a simple structure. In addition, since the use of a metal locking member can be eliminated, the number of components and the number of assembly steps do not increase, and the efficiency of manufacturing the connector is favorable.

The housing may include a projecting portion that projects in a direction crossing the insertion direction of the flat conductor from a wall surface partitioning the holding portion, and the projecting portion may include the deformation guiding portion and the retaining engagement portion.

According to the present invention, since the projecting portion is included in the housing, and the projecting portion includes both the deformation guiding portion and the retaining engagement portion, the projecting portion can be formed as a portion of the housing that is formed of a resin compact. Therefore, the structure of the connector can be simplified, and the flat-conductor connector can be reduced in size while a function of preventing the flat conductor from coming out of the flat-conductor connector is implemented. In addition, according to the present invention, the side edge portion of the flat conductor that has entered the holding portion and that has been curved and deformed by the deformation guiding portion promptly reaches the retaining engagement portion, which is integrated with the deformation guiding portion so as to form the projecting portion, and immediately returns from the state of being curved and deformed to its original shape. Thus, the projecting portion having such a configuration is less likely to cause the flat conductor to be deformed due to, for example, creep or stress relaxation. Therefore, the flatness of the flat conductor, in which the side edge portion has returned from the state of being curved and deformed to its original shapes, is maintained, and electrical connection reliability is ensured without causing a pressing force that is applied to a contact portion of a terminal to vary with location. In addition, the side edge portion will not be in the state of being curved and deformed for a long period of time, and thus, impairment of a favorable connection reliability can be prevented.

The housing may have a sliding surface that is formed in the holding portion so as to extend in the insertion direction of the flat conductor and that presses the flat conductor toward a base of the projecting portion.

According to the present invention, since the sliding surface presses the flat conductor, which is in the process of being inserted into the holding portion, toward the base of the projecting portion, when the side edge portion of the flat conductor is in contact with the deformation guiding portion, the side edge portion is further greatly curved and deformed in the plate-thickness direction of the flat conductor while the sliding surface serves as a fulcrum and may easily return from the state of being curved and deformed to its original shape after passing through the deformation guiding portion. In addition, in a state where the side edge portion of the flat conductor has returned to its original shape, the engagement portion of the side edge portion is engaged with the retaining engagement portion at a deep position on the side on which the base of the projecting portion is present (on a proximal end side that is opposite to a projecting side). Therefore, according to the present invention, in the flat-conductor connector in which the housing has the sliding surface, since the sliding surface presses the flat conductor that is in an electrically connected state toward the base of the projecting portion, and thus, a component for preventing the engagement portion from being disengaged from the retaining engagement portion is not necessary. In addition, a function of further reliably preventing the flat conductor from coming out of the flat-conductor connector can be implemented with the configuration of the housing.

The deformation guiding portion may have a first inclined surface that is formed so as to extend toward a position on the far side in the insertion direction and so as to come close to the sliding surface, and the sliding surface may have a second inclined surface that is formed at a position adjacent to the first inclined surface in a width direction of the housing so as to extend toward a position on the far side in the insertion direction and so as to come close to the deformation guiding portion.

According to the present invention, the first inclined surface and the second inclined surface are inclined so as to become closer to each other. Thus, when the flat conductor passes through these inclined surfaces, the second inclined surface can press the flat conductor toward the base of the projecting portion, and the first inclined surface can press the side edge portion in a projecting direction of the projecting portion. Therefore, according to the present invention, when the flat conductor is inserted into the holding portion, the side edge portion is pressed in the projecting direction of the projecting portion while the flat conductor is pressed toward the base of the projecting portion, and thus, the deformation guiding portion can cause the side edge portion to be curved and deformed in the plate-thickness of the flat conductor with higher certainty.

The contact portion of the terminal that is brought into contact with the flat conductor may be disposed in the holding portion, and the contact portion may be provided at a position different from a position of the deformation guiding portion in the insertion direction.

According to the present invention, a front end of the flat conductor comes into contact with the deformation guiding portion and the contact portion of the terminal at different timings, and thus, an insertion force required for inserting the flat conductor into the holding portion can be reduced, and the efficiency of a connection operation is improved.

The contact portion may be located on the far side of the deformation guiding portion in the insertion direction.

According to the present invention, the front end of the flat conductor comes into contact with the deformation guiding portion, which causes the flat conductor to be curved and deformed, with a relatively small insertion force and then comes into contact with contact portions of a plurality of the terminals, which are elastically deformed, with a relatively large insertion force. Thus, an insertion force that is generated by the curving deformation of the flat conductor, which occurs when the flat conductor is inserted into the holding portion, and an insertion force that is generated by the elastic deformation of the contact portions can be prevented from being generated at the same time, and the insertion force gradually increases. Therefore, the operability is favorable, and the efficiency of the connection operation is improved.

The holding portion may have an opening that is in communication with the outside of the housing, and the opening may be formed so as to have such a size that a portion of the flat conductor that extends from the front end (an edge portion on the insertion side) of the side edge portion of the flat conductor to the engagement portion in the insertion direction is fitted into the opening.

According to the present invention, since the opening is formed so as to have such a size that a portion of the flat conductor that extends from the front end (the edge portion on the insertion side) of the side edge portion of the flat conductor to a portion that engages the retaining engagement portion in the insertion direction is fitted into the opening, it can be easily determined by visual observation from the outside of the housing through the opening whether the flat conductor has been reliably fitted into the connector. Therefore, incomplete insertion of the flat conductor and incomplete electrical connection between the flat conductor and the flat-conductor connector can be prevented from occurring, and connection reliability can be ensured.

The housing may have a clearance portion that is formed at a position facing the projecting portion and into which the side edge portion that has been curved and deformed by coming into contact with the projecting portion is inserted.

According to the present invention, the clearance portion has a clearance space into which the side edge portion that has been curved and deformed is inserted, and thus, the side edge portion can be further greatly curved and deformed by the deformation guiding portion. Consequently, the degree of engagement between the side edge portion and the retaining engagement portion in the plate-thickness direction of the flat conductor can be increased, and thus, the effect of preventing the flat conductor from coming out of the flat-conductor connector can be improved.

According to the flat-conductor connector of the present invention, since the housing itself has a structure for preventing the flat conductor from coming out of the flat-conductor connector, the flat conductor can be prevented from coming out of the flat-conductor connector without using a locking member, which is a different member from the housing, together with the housing as in the related art, and a favorable electrical connection can be maintained with certainty.

DESCRIPTION OF THE PREFERRED EMBODIMENTS

A flat-conductor connector according to an embodiment of the present invention will be described below with reference to the drawings. A flat-conductor connector 1 of the present embodiment, which will be described below, is configured to be mounted onto a substrate 2 so as to electrically connect a flat conductor 3 which is flat-plate shaped, such as a flexible printed circuit (FPC) or a flexible flat cable (FFC), to a circuit on the substrate 2.

Figure 1:
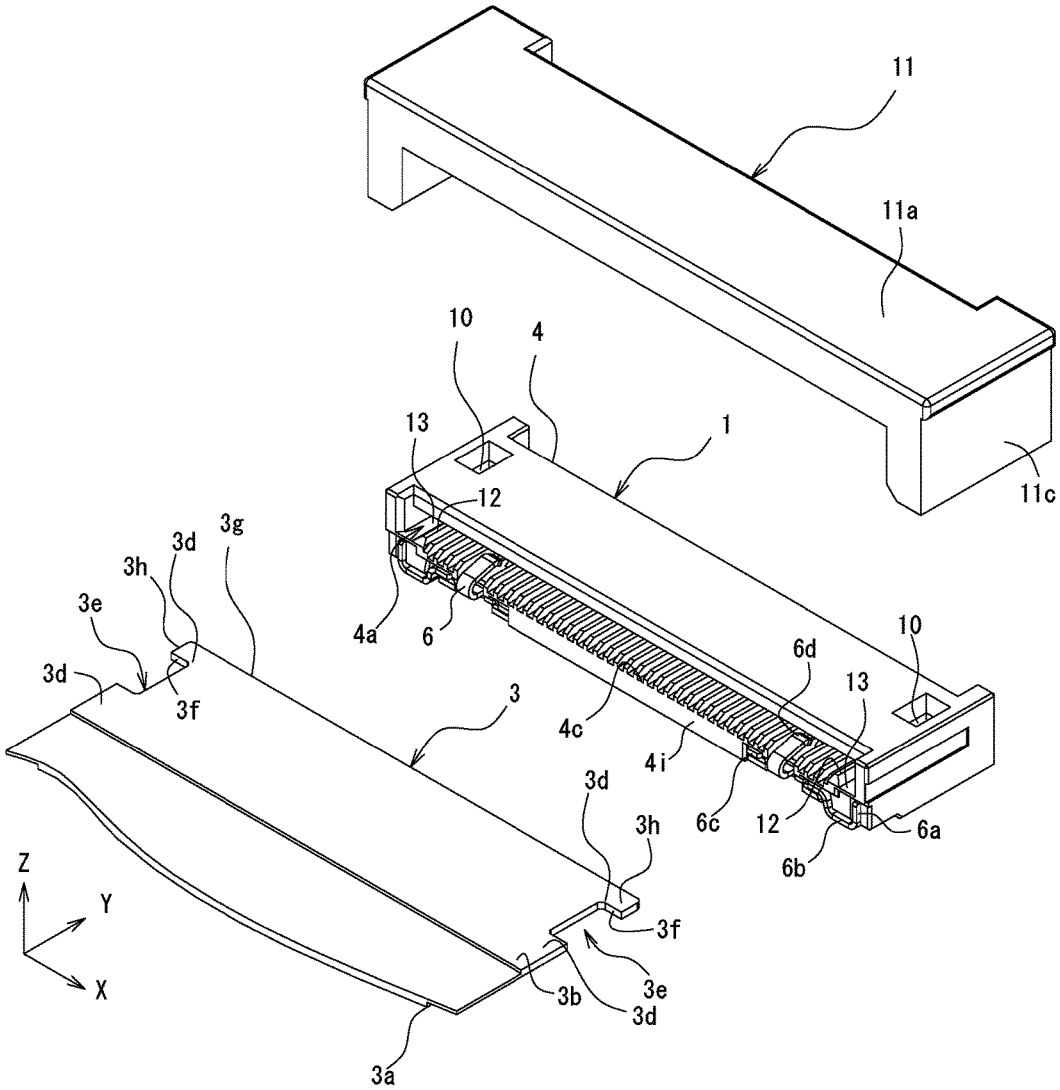
FIG. 1 is an external perspective view including a front view, a right-hand side view, and a plan view of a flat-conductor connector, a flat conductor, and a jig according to an embodiment of the present invention.

The terms "first" and "second" that are mentioned in the present specification and in the claims are used for distinguishing different components according to the present invention and are not used for indicating either a specific order or merits and demerits. In addition, in the present specification and the claims, for convenience of description, the longitudinal direction, the lateral direction, and the height direction of the flat-conductor connector 1 will be respectively defined as an X direction, a Y direction, and a Z direction as illustrated in FIG. 1 and the like. In the following description, in the height direction of the flat-conductor connector 1 (Z direction), the side on which the substrate 2 (see FIG. 9 and FIG. 10) is disposed is defined as a lower side, and the side on which the flat-conductor connector 1 is disposed is defined as an upper side. However, these terms do not limit either a fitting direction of the flat-conductor connector 1 or the way in which the flat-conductor connector 1 is mounted onto the substrate 2.

Flat-Conductor Connector 1

As illustrated in FIG. 1 to FIG. 6, the flat-conductor connector 1 includes a housing 4, terminals 5 (FIG. 2 to FIG. 5, FIG. 7), and ground terminals 6. As illustrated in FIG. 1, the flat conductor 3 is inserted into the flat-conductor connector 1 while a front end 3*g* is the head of the flat conductor 3. The flat conductor 3 includes a conductive line 3*c* (FIG. 9) that is located on the front side in an insertion direction (Y direction) and that is to be electrically connected to the terminals 5 of the flat-conductor connector 1 and a ground plate 3*a* that is located on the rear side of the conductive line 3*c* and that is to be electrically connected to the ground terminals 6 of the flat-conductor connector 1.

Figure 9:
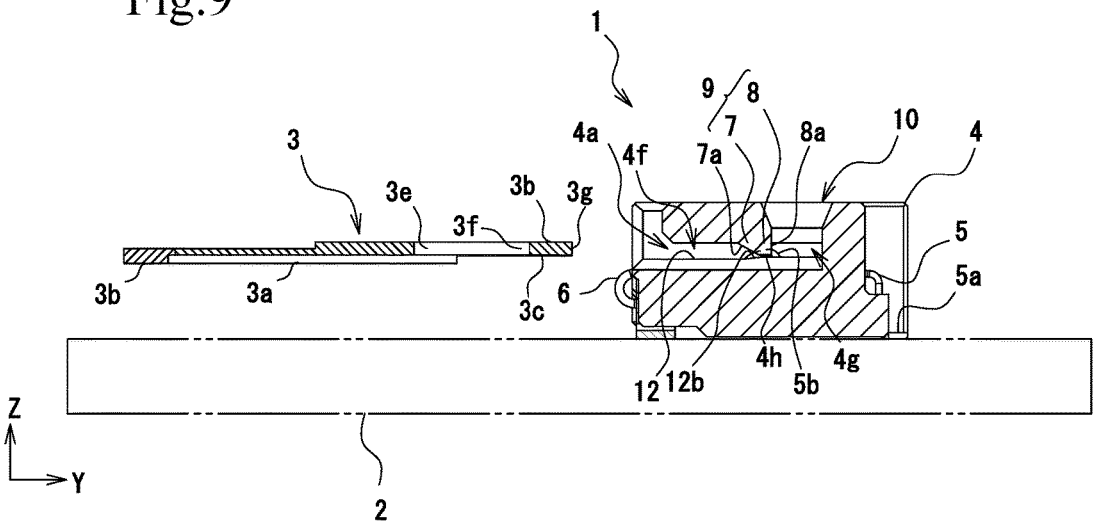
FIG. 9 is a cross-sectional view taken along line VIII-VIII of FIG. 2 illustrating a state where the flat-conductor connector and the flat conductor have not yet been fitted to each other.

As illustrated in FIG. 9, the flat conductor 3 is formed by laminating insulating layers 3*b* on the top and bottom surfaces of a layer including the conductive line 3*c* in a plate-thickness direction of the flat conductor 3 (Z direction). The bottom surface of the conductive line 3*c* is exposed on the front side in the direction in which the flat conductor 3 is inserted into the housing 4, and the exposed portion is to be electrically connected to the terminals 5 of the flat-conductor connector 1.

The ground plate 3*a* is stacked on the bottom surface of the flat conductor 3 excluding the end portions of the bottom surface in a width direction (X direction), the bottom surface being located on the side on which the ground plate 3*a* is brought into contact with the ground terminals 6. The ground plate 3*a* is to be electrically connected to the ground terminals 6.

Figure 11:
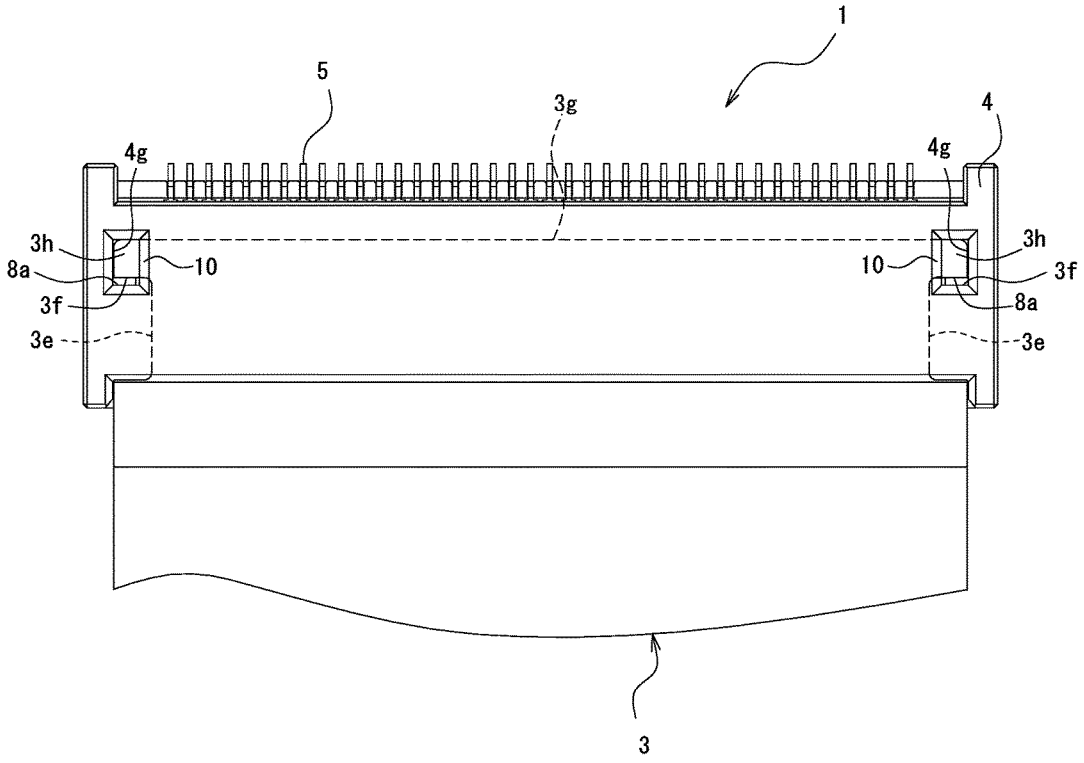
FIG. 11 is a plan view illustrating a state where the flat-conductor connector and the flat conductor, which are illustrated in FIG. 1, are fitted to each other.

As illustrated in FIG. 1, the flat conductor 3 includes side edge portions 3*d* each of which extends in the width direction starting from one of the side edges of the flat conductor 3 in the width direction so as to have a length within a predetermined range. The flat conductor 3 has flexibility (elasticity) that enables the flat conductor 3 to be curved and deformed in the plate-thickness direction of the flat conductor 3. Accordingly, the side edge portions 3*d* also have flexibility that enables the side edge portions 3*d* to be curved and deformed in the plate-thickness direction of the flat conductor 3. In addition, the side edge portions 3*d* have recesses 3*e* each of which is formed by cutting out the flat conductor 3 in a recessed manner from one of the side edges of the flat conductor 3 toward the inner side in the width direction. The recesses 3*e* have edges 3*f* that extend in the width direction of the flat conductor 3 (X direction) and that serve as "engagement portions", and the edges 3*f* engage retaining engagement portions 8 of projecting portions 9, which will be described later. Engagement pieces 3*h* that share the edges 3*f* are formed on the front-end side of the recesses 3*e* (FIG. 1, FIG. 11). The shape of each of the recesses 3*e* described in the present embodiment may be the above-mentioned cutout shape, a hole shape, or any of other shapes as long as the recesses 3*e* function as the "engagement portions" that can prevent the flat conductor 3 from coming out of the flat-conductor connector 1 by engaging the projecting portions 9, which will be described later.

The configuration of the flat-conductor connector 1 will be described below.

Housing 4

Figure 8:
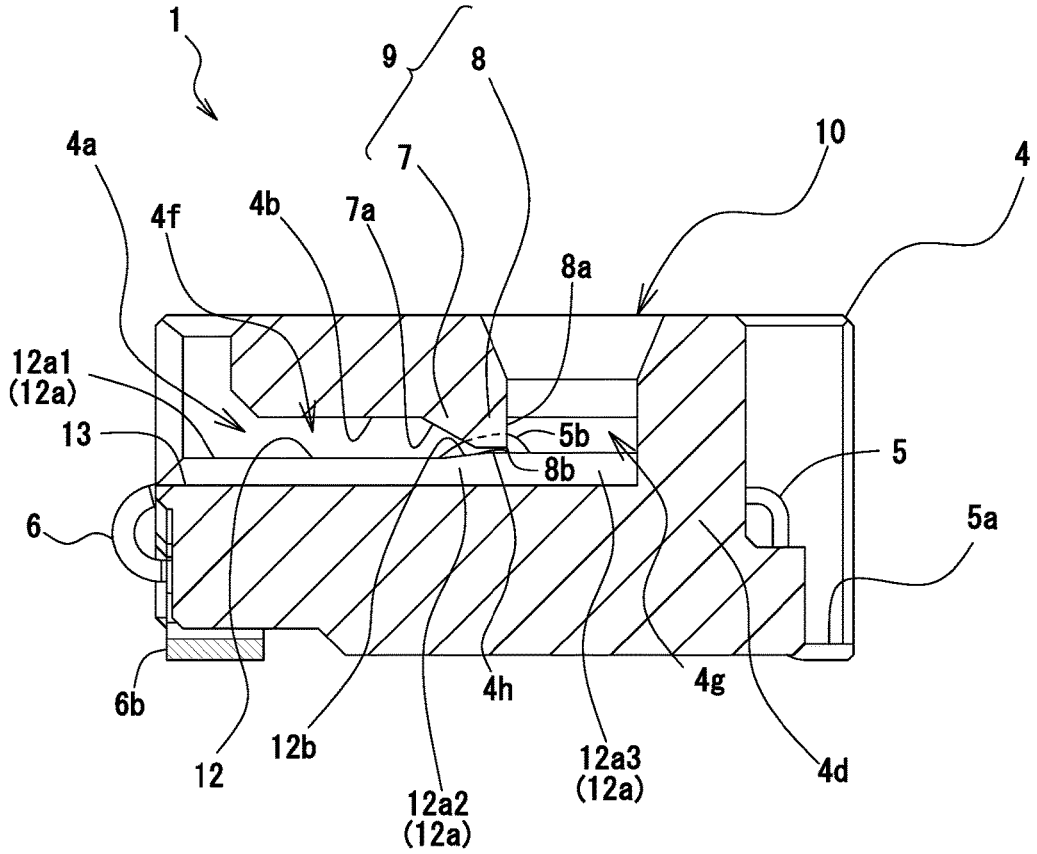
FIG. 8 is a cross-sectional view taken along line VIII-VIII of FIG. 2.

The housing 4 is formed of an insulating resin compact and is formed in a rectangular parallelepiped shape as illustrated in FIG. 2 to FIG. 6. A slot 4*a* through which the flat conductor 3 is inserted into the flat-conductor connector 1 in the lateral direction of the housing 4 (Y direction) is formed in one of the side walls of the housing 4 (FIG. 1, FIG. 8, FIG. 9). In the housing 4, a holding portion 4*f* in which the flat conductor 3 is to be held is formed on the far side of the slot 4*a* so as to communicate with the slot 4*a* (FIG. 8). The holding portion 4*f* is a space for holding the flat conductor 3, which has been electrically connected to the circuit on the substrate 2, in a fitted state. In the holding portion 4*f*, the terminals 5 and the ground terminals 6 are capable of being elastically deformed in the height direction (Z direction) in which the terminals 5 and the ground terminals 6 are press-fitted into contact with the flat conductor 3.

Figure 7:
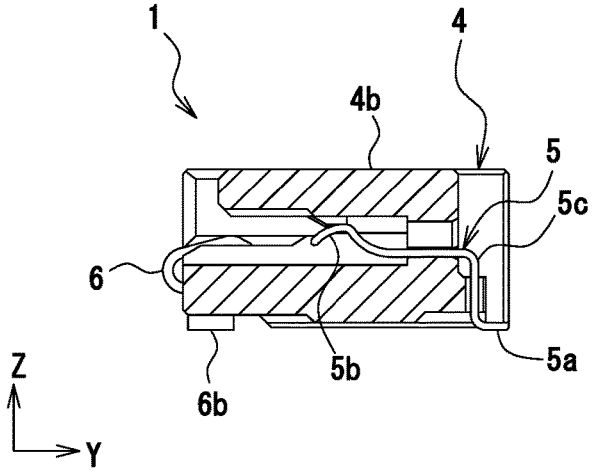
FIG. 7 is a cross-sectional view taken along line VII-VII of FIG. 2.

As illustrated in FIG. 7, the terminals 5 are disposed on the far side of the holding portion 4*f*, and the terminals 5 and the conductive line 3*c* of the flat conductor 3 are to be electrically connected to each other at these positions. In the height direction of the holding portion 4*f* (Z direction), a top-surface portion 4*b* (FIG. 8) is formed on the upper side of the holding portion 4*f*, and slits 4*c* (FIG. 1, FIG. 2, FIG. 4) are formed in a bottom wall 4*i* of the housing 4 on the lower side of the holding portion 4*f*. The terminals 5 project into the holding portion 4*f* through the slits 4*c* so as to come into contact with the conductive line 3*c* of the flat conductor 3 from below. In addition, the terminals 5 press the flat conductor 3 against the top-surface portion 4*b*.

The ground terminals 6 are disposed at positions on the near side of the holding portion 4*f*, that is, the side on which the slot 4*a* is present, and the ground terminals 6 and the ground plate 3*a* come into contact with each other at these positions.

Terminal 5

Each of the terminals 5 is formed of an electrically conductive metal piece. As illustrated in FIG. 7, each of the terminals 5 includes a substrate-connecting portion 5*a* at a first end thereof and a contact portion 5*b* at a second end thereof. In addition, each of the terminals 5 includes a spring portion 5*c* positioned between the substrate-connecting portion 5*a* and the contact portion 5*b*. The plurality of terminals 5 are arranged side by side in the longitudinal direction of the housing 4 (X direction) (FIG. 2 to FIG. 5).

Each of the substrate-connecting portions 5*a* extends to the outside of the housing 4 and is fixed to the substrate 2 with solder. Each of the terminals 5 is press-fitted into the housing 4 such that a portion of the terminal 5 between the substrate-connecting portion 5*a* and the contact portion 5*b* extends through a wall body 4*d* (FIG. 8) of the housing 4, and in this state, the terminal 5 is fixed to the housing 4. The terminals 5 and the housing 4 may be integrally formed by insert molding.

Each of the contact portions 5*b* extends in a cantilever manner from a portion of the corresponding terminal 5 that is fixed to the housing 4 toward the slot 4*a* in a front-rear direction of the housing 4 (Y direction). The contact portion 5*b* is supported so as to elastically deform in the height direction of the flat-conductor connector 1 while the portion of the corresponding terminal 5 that is fixed to the housing 4 serves as a fulcrum. In addition, the contact portion 5*b* is bent in a mountain-like shape in a direction (Z direction) in which the contact portion 5*b* comes into contact with the flat conductor 3. The contact portion 5*b* is to be electrically connected to the flat conductor 3 at a position in the vicinity of the top of the mountain-like shape of the contact portion 5*b* extending in the front-rear direction, the top being a substantially central portion of the contact portion 5*b*.

Ground Terminal 6

Each of the ground terminals 6 is formed of an electrically conductive metal plate and also functions as a reinforcing member that reinforces the wall body 4*d* that form part of the holding portion 4*f*. As illustrated in FIG. 1, FIG. 2, and FIG. 4 to FIG. 10, the pair of ground terminals 6 are disposed on the lower side of the housing 4 and on the side on which the slot 4*a* is present such that the pair of ground terminals are located on the opposite sides of the housing 4 in the longitudinal direction of the housing 4. The pair of ground terminals 6 are formed symmetrically to each other. Each of the ground terminals 6 includes a fixing portion 6*a*, a ground connecting portion 6*b*, a reinforcing plate 6*c*, and a ground contact portion 6*d*.

The fixing portions 6*a* extend toward the far side in the lateral direction of the housing 4. The fixing portions 6*a* fix the ground terminals 6 to the housing 4. The fixing portions 6*a* are press-fitted into press-fitted holes 4*e* (FIG. 2), each of which is formed in the bottom surface of the housing 4 at positions on the outer side in the longitudinal direction of the housing 4 so as to extend toward the far side in the lateral direction of the housing 4.

Each of the ground connecting portions 6*b* has a plate surface that is parallel to the bottom surface of the housing 4. Each of the ground connecting portions 6*b* is exposed to the outside at a position between the corresponding fixing portion 6*a* and the corresponding reinforcing plate 6*c* on the lower side of the housing 4. The bottom surface of each of the ground connecting portions 6*b* is soldered to a ground-connection pad of the substrate 2. As a result, the flat-conductor connector 1 is fixed to the substrate 2. The flat conductor 3 fitted into the flat-conductor connector 1 is connected to the substrate 2 by the ground connecting portions 6*b*.

Each of the reinforcing plates 6*c* extends in the longitudinal direction and the lateral direction of the housing 4 and has a plate surface that is parallel to the bottom surface of the housing 4. The reinforcing plates 6*c* reinforce the wall body 4*d* on the bottom surface side of the housing 4. Each of the reinforcing plates 6*c* is inserted into the wall body 4*d* on the bottom surface side of the housing 4 so as to be positioned between portions of the wall body 4*d* in the thickness direction of the wall body 4*d*. As a result of the reinforcing plates 6*c* being provided, the wall body 4*d* is less likely to deform even when the wall body 4*d* is pressed by the flat conductor 3 that is inserted into the holding portion 4*f*.

Each of the ground contact portions 6*d* extends from the corresponding reinforcing plate 6*c* toward the slot 4*a* of the housing 4 and is bent upward in a U-shape such that an end of the ground contact portion 6*d* enters the holding portion 4*f*. Each of the ground contact portions 6*d* is bent in a mountain-like shape so as to come into contact with the ground plate 3*a* of the flat conductor 3.

Projecting Portion 9

Figure 2:
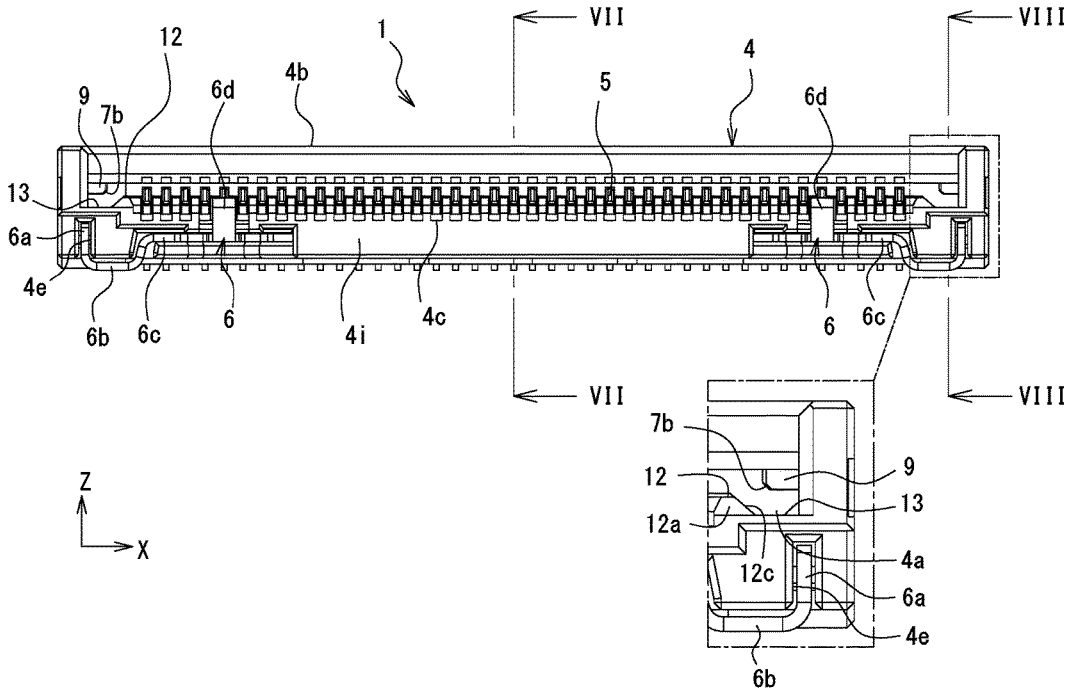
FIG. 2 is a front view of the flat-conductor connector illustrated in FIG. 1.
Figure 3:
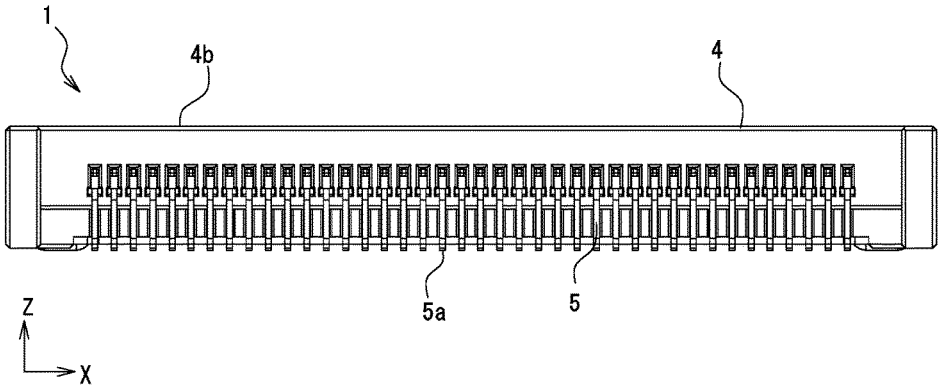
FIG. 3 is a rear view of the flat-conductor connector illustrated in FIG. 1.
Figure 4:
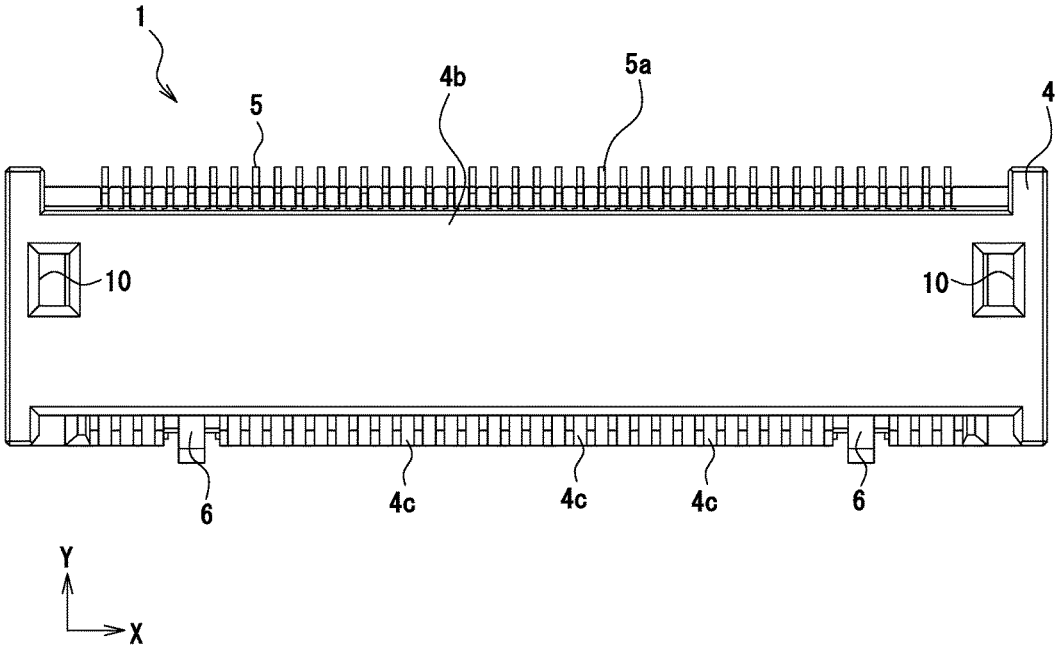
FIG. 4 is a plan view of the flat-conductor connector illustrated in FIG. 1.
Figure 5:
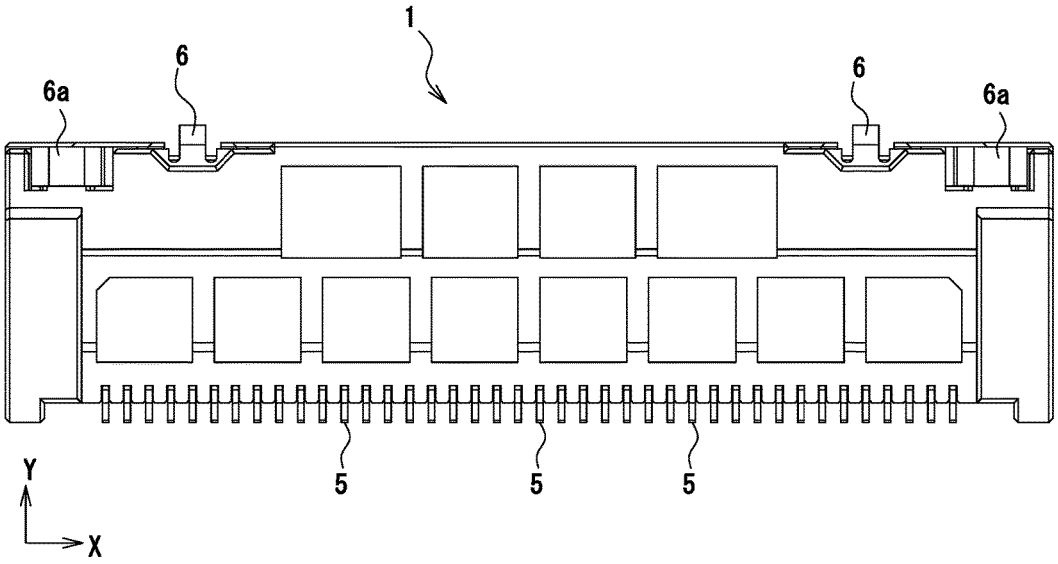
FIG. 5 is a bottom view of the flat-conductor connector illustrated in FIG. 1.
Figure 6:
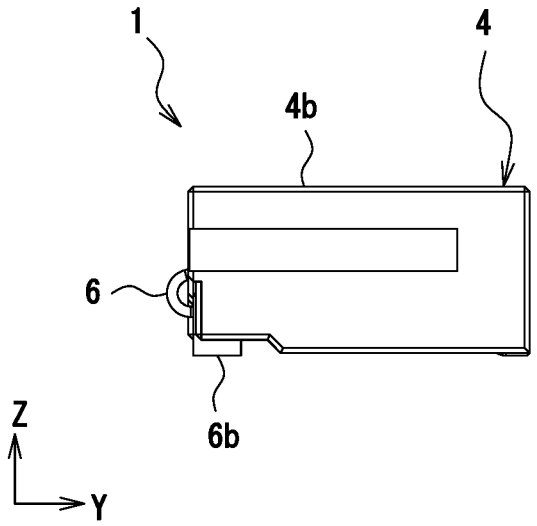
FIG. 6 is a right side view of the flat-conductor connector illustrated in FIG. 1.

The housing 4 includes the projecting portions 9 each projecting from a wall surface (the top-surface portion 4*b*), which partitions the holding portion 4*f*, in a direction crossing the insertion direction of the flat conductor 3 (Y direction). As illustrated in FIG. 8, each of the projecting portions 9 of the present embodiment is formed so as to project downward in a mountain-like shape from the top-surface portion 4*b* toward the inside of the holding portion 4*f*. In the holding portion 4*f*, a fitting chamber 4*g* is formed on the far side of the projecting portions 9. The two projecting portions 9 are disposed on the opposite sides of the housing 4 in the longitudinal direction of the housing 4 (X direction) (FIG. 2). The projecting portions 9 are arranged at positions corresponding to the positions of the side edge portions 3*d* of the flat conductor 3, which is inserted into the holding portion 4*f*, in the longitudinal direction of the housing 4 (X direction). Thus, each of the projecting portions 9 serves as a barrier against one of the side edge portions 3*d* of the flat conductor 3, which is inserted into the holding portion 4*f*, in the insertion direction. The projecting portions 9 include deformation guiding portions 7 and the retaining engagement portions 8.

Deformation Guiding Portion 7

The deformation guiding portions 7 have a function of causing the side edge portions 3*d* to be curved and deformed by coming into contact with the flat conductor 3 inserted into the holding portion 4*f*. In other words, the flat-conductor connector 1 allows the flat conductor 3 to enter the holding portion 4*f* by causing the flat conductor 3 to be curved and deformed by using the deformation guiding portions 7 of the housing 4 instead of allowing the flat conductor 3 to enter the housing 4 by causing a locking member to be elastically displaced as in the related art.

Each of the deformation guiding portions 7 has an inclined surface 7*a* (first inclined surface) extending from the top-surface portion 4*b* obliquely downward in the height direction of the housing 4 toward the far side in the lateral direction of the housing 4. When the flat conductor 3 is inserted into the holding portion 4*f*, the edge portion on the insertion side of the side edge portions 3*d* comes into contact with the inclined surfaces 7*a* of the deformation guiding portions 7. Then, the inclined surfaces 7*a* cause the side edge portions 3*d* that are inserted further deeply in the insertion direction to be curved and deformed downward in the height direction (Z direction), that is, in the plate-thickness direction of the flat conductor 3. Since the deformation guiding portions 7 cause the side edge portions 3*d*, which are portions of the flat conductor 3 that are relatively easily deformed, to be curved and deformed in the plate-thickness direction of the flat conductor 3, when the side edge portions 3*d* of the flat conductor 3 pass through the deformation guiding portions 7 and are unloaded, the side edge portions 3*d* return to their original shapes and do not become plastically deformed.

As illustrated in FIG. 8, each of the deformation guiding portions 7 of the present embodiment has a top-surface portion 4*h* extending from a trailing end of the inclined surface 7*a*, which is located on the far side, in the insertion direction of the flat conductor 3 (Y direction) so as to be parallel to the bottom surface of the holding portion 4*f*. The inclined surface 7*a* and the top-surface portion 4*h* are shaped so as to be connected to each other forming a ridge line (a corner). However, the inclined surface 7*a* and the top-surface portion 4*h* may be shaped so as to be connected to each other forming a curved surface instead of a ridge line. Connecting each of the inclined surfaces 7*a* and the corresponding top-surface portion 4*h* to each other so as to form a curved surface enables the flat conductor 3 to smoothly pass through the deformation guiding portion 7 and causes the orientation of the edge portion on the insertion side of the side edge portions 3*d* to become closer to the horizontal direction along the top-surface portions 4*h*, so that the side edge portions 3*d* are likely to return from the state of being curved and deformed to their original shapes more quickly after passing through the deformation guiding portions 7.

Here, the contact portions 5*b* are arranged at positions different from the positions of the deformation guiding portions 7 in the insertion direction of the flat conductor 3. In the housing 4 of the present embodiment, as illustrated in FIG. 8, the contact portions 5*b* are positioned further toward the far side than the starting points of the inclined surfaces 7*a* are in the insertion direction of the flat conductor 3. In the case where the deformation guiding portions 7 and the contact portions 5*b* satisfy such a positional relationship, when the flat conductor 3 is inserted into the holding portion 4*f*, the front end 3*g* of the flat conductor 3 do not come into contact with the deformation guiding portions 7 and the contact portions 5*b* at the same time. The flat conductor 3 is inserted into the holding portion 4*f* such that the front end 3*g* of the flat conductor 3 sequentially comes into contact with the deformation guiding portions 7 and the contact portions 5*b* of the terminals 5 in this order at different timings, and thus, an insertion force generated when the flat conductor 3 is connected to the flat-conductor connector 1 can be dispersed. A large insertion force is not necessary for insertion of the flat conductor 3, and thus, the operational efficiency connecting the flat conductor 3 to the flat-conductor connector 1 is improved.

In each of the deformation guiding portions 7 of the present embodiment, as illustrated in FIG. 2, a corner portion 7*b* that is located on the inner side in the longitudinal direction of the housing 4 and on the lower side in the height direction of the housing 4 is chamfered. The corner portions 7*b* come into surface contact with the flat conductor 3 instead of coming into line contact with the flat conductor 3 so as to increase the contact area between the flat conductor 3 and the deformation guiding portions 7, so that the pressure can be dispersed. Thus, the flat conductor 3 can be prevented from breaking by, for example, being scraped when passing through the deformation guiding portions 7. In addition, if the flat conductor 3 comes into line contact with the deformation guiding portions 7, the side edge portions 3*d* are likely to become plastically deformed as a result of being deformed or bent with a large curvature or as a result of being deformed in the opposite direction (in which side edge ends of the side edge portions 3*d* faces upward). However, since the corner portions 7*b* cause the side edge portions 3*d* to be curved with a small curvature by increasing the contact area between the flat conductor 3 and the deformation guiding portions 7 with their chamfered shapes, the side edge portions 3*d* can be prevented from breaking due to their excessive deformation, and the side edge portions 3*d* can be easily return from the state of being curved and deformed to their original shapes after passing through the deformation guiding portions 7.

In the present embodiment, although the chamfered shape of each of the corner portions 7*b* is formed so as to be uniform from a position on the near side of the corresponding deformation guiding portion 7 (on the side on which the slot 4*a* is present) to a position on the far side of the deformation guiding portion 7, the chamfered shape may be a different shape. For example, the chamfered shape may be a shape in which the inclination gradually decreases from the starting point toward the ending point of the inclined surface 7*a* of the deformation guiding portion 7 and in which a side surface extending in the vertical direction of the corresponding projecting portion 9 is formed. As a result, the deformation guiding portion 7 can cause the side edge portions 3*d* to be gradually curved and deformed, and thus, the flat conductor 3 does not break due to its sudden deformation. In addition, for example, the angle of the chamfered shape may be changed such that the inclination is steepest in the vicinity of the center between the starting point and the ending point of the inclined surface 7*a*. As a result, the side edge portions 3*d* may easily be return to their original shapes after passing through the deformation guiding portions 7.

Retaining Engagement Portion 8

The retaining engagement portions 8 engage the flat conductor 3 so as to prevent the flat conductor 3 from coming out of the flat-conductor connector 1 and improve the connection reliability between the flat conductor 3 and the flat-conductor connector 1. Each of the retaining engagement portions 8 is formed on the far side of the corresponding deformation guiding portion 7 in the insertion direction of the flat conductor 3 so as to be a surface extending in a direction (Z direction) crossing the insertion direction of the flat conductor 3. As illustrated in FIG. 8, each of the retaining engagement portions 8 includes an engagement wall 8*a* extending from the top-surface portion 4*h* of the deformation guiding portion 7, which is located on the far side, upward in the height direction of the housing 4. The engagement walls 8*a* face the fitting chamber 4*g*. The edges 3*f* (FIG. 1, FIG. 10, FIG. 11) of the recesses 3*e* that serve as the "engagement portions" and that are formed in the side edge portions 3*d* of the flat conductor 3, which have returned from the state of being curved and deformed to their original shapes, engage the engagement walls 8*a* in a direction in which the flat conductor 3 is to be pulled out from the flat-conductor connector 1.

When the flat conductor 3 is held in the holding portion 4*f*, the side edge portions 3*d* are pressed downward by the deformation guiding portions 7 so as to be curved and deformed. In this state, by inserting the flat conductor 3 further deeply toward the far side of the holding portion 4*f*, the engagement pieces 3*h* of the side edge portions 3*d* enter the fitting chamber 4*g*, and the deformation guiding portions 7 are disposed in the recesses 3*e*. This brings the edges 3*f* of the flat conductor 3 into a state of being engageable with the retaining engagement portions 8. In other words, instead of preventing the flat conductor 3 from coming out of the flat-conductor connector 1 by causing a locking member that has been elastically displaced to return to its original shape as in the related art, the flat conductor 3 is prevented from coming out of the flat-conductor connector 1 as a result of the edges 3*f* of the flat conductor 3 that has returned from a state of being curved and deformed to its original shape being engaged with the retaining engagement portions 8 of the housing 4. This brings the flat conductor 3 into a locked state in the flat-conductor connector 1 and brings the contact portions 5*b* of the terminals 5 into an electrically connected state in which the contact portions 5*b* of the terminals 5 are electrically connected to the conductive line 3*c* of the flat conductor 3. While the flat conductor 3 is in the locked state, even if the flat conductor 3 is pulled, the edges 3*f* are engaged with the engagement walls 8*a*, so that the flat conductor 3 is prevented from coming out of the flat-conductor connector 1.

In the case where a corner portion 8*b* between each of the top-surface portions 4*h* and the corresponding engagement wall 8*a* forms an obtuse angle, the height at which the edges 3*f* are kept engaged with the engagement walls 8*a* is small, and thus, the edges 3*f* are likely to be disengaged from the engagement walls 8*a*. Therefore, it is preferable that each of the corner portions 8*b* form a right angle or an angle smaller than a right angle, and in the present embodiment, each of the corner portions 8*b* forms a right angle.

According to the present embodiment, by simply inserting the flat conductor 3 into the holding portion 4*f* of the housing 4, the flat conductor 3 can be prevented from coming out of the flat-conductor connector 1 by the deformation guiding portions 7 and the retaining engagement portions 8, which are included in the housing 4, and the use of a metal locking member as in the related art can be eliminated. As described above, in the flat-conductor connector 1 of the present embodiment, since the deformation guiding portions 7 and the retaining engagement portions 8 are included in the housing 4, a function of preventing the flat conductor 3 from coming out of the flat-conductor connector 1 can be implemented with a simple structure. In addition, since the use of a metal locking member can be eliminated, the number of components and the number of assembly steps do not increase, and the efficiency of manufacturing the flat-conductor connector 1 is favorable.

Sliding Surface 12

The housing 4 has sliding surfaces 12 that are formed in the holding portion 4*f* so as to extend in the insertion direction of the flat conductor 3. The sliding surfaces 12 have a function of pressing the flat conductor 3 inserted into the holding portion 4*f* toward the bases of the projecting portions 9 and positioning the flat conductor 3 in the holding portion 4*f* in the height direction. As illustrated in FIG. 2, the sliding surfaces 12 of the present embodiment are formed on the top surfaces of base portions 12*a*, each of the base portions 12*a* projecting from the bottom wall 4*i* of the holding portion 4*f* of the housing 4 upward in the height direction so as to have a quadrangular pyramid-like shape. In addition, the sliding surfaces 12 are formed so as to linearly extend from the slot 4*a* toward the inside of the holding portion 4*f* in the insertion direction of the flat conductor 3, that is, in the front-rear direction of the housing 4. The sliding surfaces 12 are arranged on the opposite sides of the housing 4 in the longitudinal direction of the housing 4, and each of the sliding surfaces 12 is located on the inner side of a corresponding one of the projecting portions 9.

Since the sliding surfaces 12 press the flat conductor 3, which is in the process of being inserted into the holding portion 4*f*, toward the bases of the projecting portions 9, when the side edge portions 3*d* of the flat conductor 3 are in contact with the deformation guiding portions 7, the side edge portions 3*d* of the flat conductor 3 are further greatly curved and deformed in the plate-thickness direction of the flat conductor 3 while each of the sliding surfaces 12 serves as a fulcrum, so that the side edge portions 3*d* of the flat conductor 3 can smoothly pass through the retaining engagement portions 8. In addition, since the sliding surfaces 12 press the flat conductor 3 toward the bases of the projecting portions 9, the flat conductor 3 and the side edge portions 3*d* of the flat conductor 3 easily return to their original shapes after passing through the deformation guiding portions 7. Thus, according to the flat-conductor connector 1 of the present embodiment, in which the housing 4 has the sliding surfaces 12, since the sliding surfaces 12 press the flat conductor 3 that is in an electrically connected state toward the bases of the projecting portions 9, a component for preventing the edges 3*f* from being disengaged from the retaining engagement portions 8 is not necessary, and a function of further reliably preventing the flat conductor 3 from coming out of the flat-conductor connector 1 can be implemented with the configuration of the housing 4.

As illustrated in FIG. 8, the distance between the bottom surface of the top-surface portion 4*b* of the holding portion 4*f* and each of the sliding surfaces 12 corresponds to the height of the holding portion 4*f* at which the flat conductor 3 can be inserted into the holding portion 4*f*. Each of the base portion 12*a* includes a smaller-height portion 12*a*1, an inclined portion 12*a*2, and a larger-height portion 12*a*3. Each of the smaller-height portions 12*a*1 is located on the side on which the slot 4*a* is present and formed such that the projection height thereof from the bottom wall 4*i* is small, so that the height of the holding portion 4*f* is larger than the plate thickness of the flat conductor 3. This enables the flat conductor 3 to be easily inserted into the holding portion 4*f* through the slot 4*a*. In contrast, each of the larger-height portions 12*a*3 is formed at a position on the far side in the holding portion 4*f* such that the projection height thereof from the bottom wall 4*i* is larger than that of each of the smaller-height portions 12*a*1, so that the height of the holding portion 4*f* and the plate thickness of the flat conductor 3 are approximately the same as each other. As a result, the flat conductor 3 inserted into the holding portion 4*f* is less likely to wobble.

Each of the inclined portions 12*a*2 is formed at a position that is adjacent to the inclined surface 7*a* of the corresponding deformation guiding portion 7 in the width direction of the housing 4 and has, as the top surface thereof, an inclined surface 12*b* (second inclined surface) that is formed so as to extend toward the far side in the insertion direction and so as to come close to the deformation guiding portion 7. Consequently, the inclined surface 7*a* and the inclined surface 12*b* are inclined so as to become closer to each other. When the flat conductor 3 passes through the inclined surfaces 7*a* and the inclined surfaces 12*b*, the inclined surfaces 12*b* can press the flat conductor 3 toward the bases of the projecting portions 9, and the inclined surfaces 7*a* can press the side edge portions 3*d* in a projecting direction of the projecting portions 9. Accordingly, when the flat conductor 3 is inserted into the holding portion 4*f*, the side edge portions 3*d* are pressed in the projecting direction of the projecting portions 9 while the flat conductor 3 is pressed toward the bases of the projecting portions 9, and thus, the deformation guiding portions 7 can cause the side edge portions 3*d* to be curved and deformed in the plate-thickness direction of the flat conductor 3 with higher certainty.

The base portions 12*a* having the top surfaces, on which the sliding surfaces 12 are formed, each have a side surface 12*c* located on the outer side in the longitudinal direction of the housing 4, and the side surface 12*c* is chamfered so as to be inclined outward in the longitudinal direction from the upper side to the lower side in the height direction. If the side surfaces 12*c* of the base portions 12*a* are not chamfered and have corners, there is a possibility that the side edge portions 3*d* of the flat conductor 3 that have been curved and deformed by the deformation guiding portions 7 will be scraped as a result of coming into contact with the sliding surfaces 12 or with ridge lines formed by the sliding surfaces 12 and the side surfaces 12*c*. However, the base portions 12*a* have the chamfered side surfaces 12*c*, so that the side edge portions 3*d* do not come into contact with either the sliding surfaces 12 or the base portion 12*a* even when the side edge portions 3*d* are curved and deformed, and the side edge portions 3*d* can be prevented from breaking.

Groove 13

The housing 4 has grooves 13 that are formed at positions facing the projecting portions 9 so as to serve as clearance portions into which the side edge portions 3*d* that have been curved and deformed by coming into contact with the projecting portions 9 are inserted. As illustrated in FIG. 2, each of the grooves 13 of the present embodiment is formed so as to be located outside one of the sliding surfaces 12 in the longitudinal direction of the housing 4 and so as to be recessed below the sliding surface 12 in the height direction. Each of the grooves 13 is linearly and continuously formed from the slot 4*a* to a position on the far side in the fitting chamber 4*g*.

In the case where the housing 4 does not have the grooves 13, when the side edge portions 3*d* of the flat conductor 3 pass through the deformation guiding portions 7, each of the side edge portions 3*d* of the flat conductor 3 needs to become deformed in a narrow gap between one of the deformation guiding portions 7 and a surface facing the deformation guiding portion 7, and there is a possibility that the side edge portions 3*d* will break. However, since the housing 4 has the grooves 13, and the grooves 13 form clearance spaces into which the side edge portions 3*d* that have been curved and deformed are inserted, the side edge portions 3*d* can be further greatly curved and deformed by the deformation guiding portions 7. Consequently, the degree of engagement between each of the side edge portions 3*d* and the corresponding retaining engagement portion 8 in the plate-thickness direction of the flat conductor 3 can be increased, and thus, the effect of preventing the flat conductor 3 from coming out of the flat-conductor connector 1 can be improved.

Opening 10

The holding portion 4*f* has openings 10 that are in communication with the outside of the housing 4. In particular, as illustrated in FIG. 11, each of the openings 10 is formed so as to have such a size that a portion of the flat conductor 3 that extends from the edge portion on the insertion side of the side edge portions 3*d* to the edge 3*f* of the corresponding recess 3*e* in the insertion direction is fitted into the opening 10. As a result, it can be easily determined by visual observation from the outside of the housing 4 through the openings 10 whether the flat conductor 3 has been reliably fitted, in a normal state, into the flat-conductor connector 1 as a result of the engagement pieces 3*h* of the flat conductor 3 having passed through the projecting portions 9 and reached the fitting chamber 4*g*. Therefore, the flat-conductor connector 1 can prevent incomplete insertion of the flat conductor 3 and incomplete electrical connection between the flat conductor 3 and the flat-conductor connector 1 from occurring and can ensure connection reliability. Each of the openings 10 of the present embodiment is formed as a through hole extending from the fitting chamber 4*g* upward in the height direction and having a quadrangular cross section. In addition, upper portions of the openings 10 are tapered so as to guide insertion of engagement releasing pieces 11*b* of a jig 11, which will be described below (FIG. 8).

Jig 11

Figure 12:
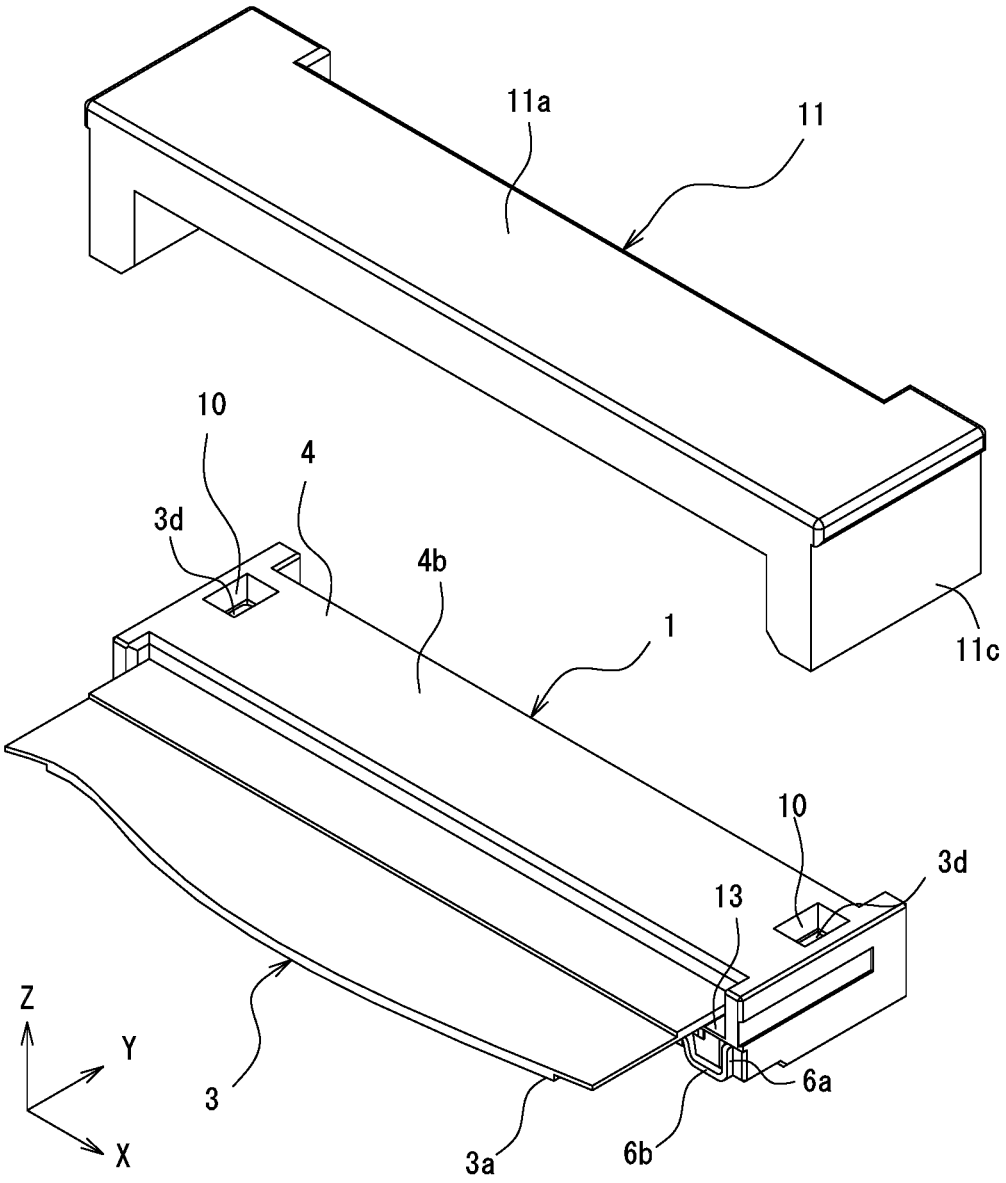
FIG. 12 is an external perspective view including a front view, a right side view, and a plan view of the flat-conductor connector and the jig, which are illustrated in FIG. 1.
Figure 13:
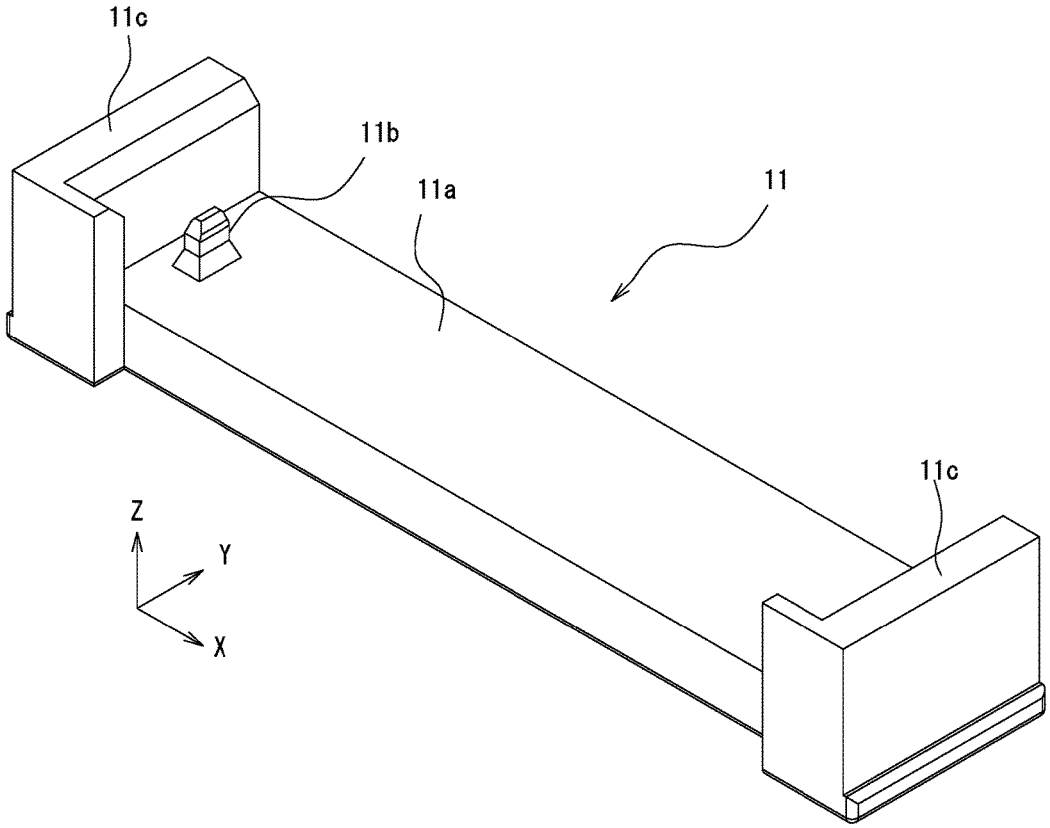
FIG. 13 is an external perspective view including a rear view, a right side view, and a bottom view of the jig illustrated in FIG. 1.

The jig 11 has a function of releasing the flat conductor 3 inserted into the housing 4 from the fitted state. As illustrated in FIG. 12, the jig 11 of the present embodiment is formed in a gate-like shape. The jig 11 includes a top plate 11*a*, the engagement releasing pieces 11*b* (FIG. 13), and leg portions 11*c*.

The top plate 11*a* has a flat plate-like shape and is formed so as to correspond to the top-surface portion 4*b* of the housing 4. When the jig 11 is used, the lower surface of the top plate 11*a* is superposed with the upper surface of the top-surface portion 4*b*.

The engagement releasing pieces 11*b* are formed so as to project downward (in the Z direction) from the bottom surface of the top plate 11*a*. Each of the engagement releasing pieces 11*b* has a length long enough to pass through one of the openings 10 of the housing 4 and to press down the entire engagement margin of one of the side edge portions 3*d* with respect to the corresponding retaining engagement portion 8. Although the cross section of each of the engagement releasing pieces 11*b* may have any shape, when the cross section of each of the engagement releasing pieces 11*b* is a shape corresponding to the cross section of one of the corresponding openings 10, the engagement releasing piece 11*b* can be stably pressed down along surfaces of peripheral walls of the opening 10, and the engaged state between each of the retaining engagement portions 8 and the corresponding side edge portion 3*d* can be released with higher certainty. In addition, when the cross section of each of the openings 10 and the cross section of each of the engagement releasing pieces 11*b* have a quadrangular shape, the engagement releasing pieces 11*b* can be pressed down without unevenly pressing the side edge portions 3*d*, and the engaged state between each of the retaining engagement portions 8 and the corresponding side edge portion 3*d* can be released without breaking the flat conductor 3.

The leg portions 11*c* have a function of positioning the engagement releasing pieces 11*b* when the engagement releasing pieces 11*b* are inserted into the openings 10. The leg portions 11*c* are located on the opposite sides of the top plate 11*a* in the longitudinal direction of the top plate 11*a*. Each of the leg portions 11*c* is formed so as to extend in the height direction while having an L-shaped cross section, and an internal corner of the leg portion 11*c* is fitted between a portion of a side surface extending in the longitudinal direction of the housing 4 and a side surface extending in the lateral direction of the housing 4. By mounting the jig 11 onto the housing 4 such that the leg portions 11*c* are fitted onto the housing 4, the engagement releasing pieces 11*b* overlap the positions of the openings 10 and can accurately press down the side edge portions 3*d*.

When the jig 11 is mounted onto the housing 4, the leg portions 11*c* are fitted onto the housing 4, so that the engagement releasing pieces 11*b* are guided to the openings 10. Here, as a result of the top plate 11*a* being pressed down toward the top-surface portion 4*b* of the housing 4, the engagement releasing pieces 11*b* are inserted into the openings 10 so as to press down the side edge portions 3*d* of the flat conductor 3. As a result, the side edge portions 3*d* are pressed down toward the substrate 2 and disengaged from the retaining engagement portions 8, and thus, the flat conductor 3 is released from the engaged state, so that the flat conductor 3 can be pulled out from the flat-conductor connector 1.

In the flat-conductor connector 1 of the present embodiment, the openings 10 also serve as insertion holes for the jig 11 that enables the flat conductor 3 to be pulled out from the flat-conductor connector 1. Therefore, it is not necessary to additionally form a jig-insertion hole in the housing 4, and the flat-conductor connector 1 having a simpler configuration can be provided with a favorable productivity.

The flat-conductor connector according to the present invention is configured as the flat-conductor connector 1 including the above-described jig 11, so that the side edge portions 3*d* can be operated from the outside of the housing 4 by using the jig 11. Therefore, the flat conductor 3 can be easily pulled out from the housing 4 by disengaging the side edge portions 3*d* from the retaining engagement portions 8.

Method of Using Flat-Conductor Connector 1

A method of using the flat-conductor connector 1 will now be described.

First, as illustrated in FIG. 9, the flat conductor 3 is inserted into the holding portion 4*f* of the flat-conductor connector 1 through the slot 4*a*. The flat conductor 3 is inserted toward the far side of the holding portion 4*f* along the sliding surfaces 12. When the flat conductor 3 is advanced, the edge portion on the insertion side of the side edge portions 3*d* comes into contact with the deformation guiding portions 7 of the projecting portions 9. Then, the side edge portions 3*d* are pressed down toward the substrate 2 so as to be curved and deformed along the deformation guiding portions 7. In a state where the side edge portions 3*d* are pressed down by the deformation guiding portions 7, when the flat conductor 3 is further advanced toward the far side of the holding portion 4*f*, the flat conductor 3 comes into contact with the contact portions 5*b* of the terminals 5. Since the flat conductor 3 comes into contact with, in different insertion stages, the deformation guiding portions 7 and the contact portions 5*b*, an insertion force required for inserting the flat conductor 3 into the holding portion 4*f* can be reduced, and the efficiency of the connection operation is improved.

In the lateral direction of the housing 4, the contact portions 5*b* of the terminals 5 are positioned so as to correspond to the positions of the inclined surfaces 12*b* of the sliding surfaces 12. Thus, the flat conductor 3 passes through the terminals 5 by pressing down the contact portions 5*b* while being raised upward in the height direction along the inclined surfaces 12*b*.

The flat conductor 3 is inserted along the sliding surfaces 12 so as to be located at a position on the far side in the holding portion 4*f* while the side edge portions 3*d* are pressed by the deformation guiding portions 7 of the projecting portions 9. Then, the edges 3*f* of the recesses 3*e* of the flat conductor 3 pass through the deformation guiding portions 7 and reach the retaining engagement portions 8 of the projecting portions 9.

Figure 10:
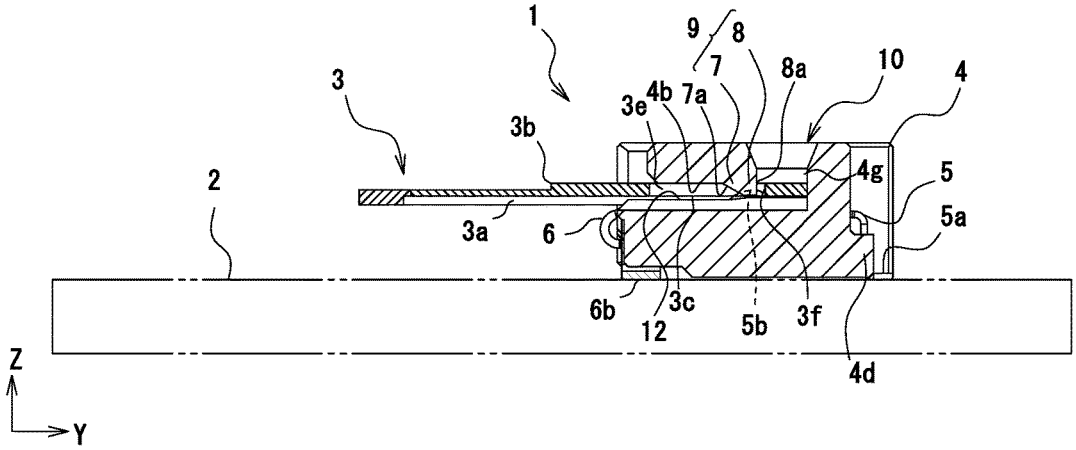
FIG. 10 is a cross-sectional view taken along line VIII-VIII of FIG. 2 illustrating a state where the flat-conductor connector and the flat conductor are fitted to each other (in an electrically connected state).

A restoring force continuously acts on the side edge portions 3*d* that have been elastically deformed in such a manner as to fall toward the grooves 13, the restoring force trying to bring the side edge portions 3*d* back toward the top-surface portion 4*b*. Thus, when the edges 3*f* of the recesses 3*e* of the flat conductor 3 reach the retaining engagement portions 8 of the projecting portions 9, the engagement pieces 3*h* of the side edge portions 3*d* enter the fitting chamber 4*g* and return to their original shapes (FIG. 10). In this case, the engagement walls 8*a* of the retaining engagement portions 8 are approximately parallel to the edges 3*f* of the recesses 3*e* and lock the flat-conductor connector 1 (FIG. 11). In this state, the flat conductor 3 is clamped between the contact portions 5*b* and the top-surface portion 4*b*, and the flat conductor 3 and the terminals 5 are electrically connected to each other. In this manner, by only performing a single operation of inserting the flat conductor 3 into the flat-conductor connector 1, the flat conductor 3 is prevented from coming out of the flat-conductor connector 1, and thus, the efficiency of the connection operation of the flat-conductor connector 1 is favorable.

When the flat conductor 3 is pulled out from the flat-conductor connector 1, the edges 3*f* of the recesses 3*e* of the flat conductor 3 need to pass through the retaining engagement portions 8 of the projecting portions 9 in the direction in which the flat conductor 3 is pulled out from the flat-conductor connector 1. For this purpose, the jig 11 is mounted onto the housing 4. As described above, by mounting the jig 11 onto the housing 4, the engagement releasing pieces 11*b* of the jig 11 pass through the openings 10 of the housing 4 and displace the side edge portions 3*d* toward the substrate 2 in such a manner as to press down the entire engagement margins of the side edge portions 3*d* with respect to the retaining engagement portions 8, so that the side edge portions 3*d* can be disengaged from the retaining engagement portions 8. In this state, the flat conductor 3 can be pulled out from the flat-conductor connector 1.

Operation and Effect of Flat-Conductor Connector 1

Operations and effects of the flat-conductor connector 1 excluding those already described above will now be described.

In a state where the flat conductor 3 is locked to the flat-conductor connector 1, when a force in the direction in which the flat conductor 3 is to be pulled out from the flat-conductor connector 1 is applied to the flat conductor 3, the retaining engagement portions 8 of the projecting portions 9 are brought into contact with the edges 3*f* of the recesses 3*e* of the flat conductor 3, so that the flat conductor 3 is prevented from coming out of the flat-conductor connector 1, and the contact state between the terminals 5 of the flat-conductor connector 1 and the flat conductor 3 is maintained. Consequently, the flat conductor 3 can be locked to the flat-conductor connector 1 without providing a separate member such as an actuator or a slider. Therefore, the number of components and the number of assembly steps do not increase, and the efficiency of manufacturing the flat-conductor connector 1 is favorable. In addition, although a metal locking member of the related art includes an unlocking operation piece that is to be exposed to the outside of the housing 4, the flat-conductor connector 1 of the present embodiment does not include such an operation piece, and thus, the flat conductor 3 will not become detached from the flat-conductor connector 1 as a result of a user inadvertently touching such an operation piece. Therefore, the flat-conductor connector 1 of the present embodiment can improve the connection reliability with the flat conductor 3.

As described above, in the flat-conductor connector 1 of the present embodiment, by only performing a single operation of inserting the flat conductor 3 into the flat-conductor connector 1, a favorable operational efficiency for restricting movement of the flat conductor 3 in the direction in which the flat conductor 3 is to be pulled out from the flat-conductor connector 1 (a favorable operational efficiency for preventing the flat conductor 3 from coming out of the flat-conductor connector 1) can be obtained with a simple configuration and without using an additional member. Therefore, the manufacturing costs can be reduced, and the productivity is favorable. According to the present embodiment, since the housing 4 itself has a structure for preventing the flat conductor 3 from coming out of the flat-conductor connector 1, the flat conductor 3 can be prevented from coming out of the flat-conductor connector 1 without using a locking member, which is a different member from the housing, together with the housing as in the related art, and a favorable electrical connection can be maintained with certainty.

Modification

In the present embodiment, the flat-conductor connector 1 that is horizontally mounted onto the substrate 2 and performs so-called angle connection of the flat conductor 3 has been described. In contrast, although not illustrated, a connector of a modification may be configured to be vertically mounted onto the substrate 2 and configured to perform so-called straight connection of the flat conductor 3. In this case, the flat conductor 3 may be inserted into the holding portion 4*f* through the slot 4*a* in a direction perpendicular to the substrate 2.

Each of the deformation guiding portions 7 and the corresponding retaining engagement portion 8 may be formed as different members. However, in the case where the projecting portions 9 which includes the deformation guiding portions 7 and the corresponding retaining engagement portion 8 are integrated each other is included in the housing 4, the projecting portions 9 can be formed as portions of the housing 4, which is formed of an insulating resin compact. In addition, the structure of the flat-conductor connector 1 can be simplified, and the flat-conductor connector 1 can be reduced in size while a function of preventing the flat conductor 3 from coming out of the flat-conductor connector 1 is implemented. Furthermore, the side edge portions 3*d* of the flat conductor 3 that have been curved and deformed by the deformation guiding portions 7 promptly reach the retaining engagement portions 8, which are integrated with the deformation guiding portions 7, and return from the state of being curved and deformed to their original shapes, and thus, the projecting portions 9 each having such a configuration are less likely to cause the flat conductor 3 to be deformed due to creep or stress relaxation. Therefore, the flatness of the flat conductor 3, in which the side edge portions 3*d* have returned from the state of being curved and deformed to their original shapes, is maintained, and electrical connection reliability is ensured without causing the pressing force applied to the contact portions 5*b* of the terminals 5 to vary with location. In addition, the side edge portions 3*d* will not be in the state of being curved and deformed for a long period of time, and thus, impairment of a favorable connection reliability can be prevented.

As illustrated in FIG. 2, the flat-conductor connector 1 of the present embodiment has a structure in which the terminals 5 and the ground terminals 6 are formed on the lower side of the housing 4. The terminals 5 are located on the side opposite to the side on which the projecting portions 9 are disposed and support the flat conductor 3 toward the projecting portions 9 in the plate-thickness direction of the flat conductor 3. In the flat-conductor connector 1 of the present embodiment, each of the terminals 5 has a function of pressing the flat conductor 3, and consequently, other configurations for supporting the flat conductor 3 are not necessary.

The internal structure of the housing 4 (including the arrangement of the terminals 5, the projecting direction of the projecting portions 9, the projecting direction of the base portions 12*a*, and the arrangement of the grooves 13) may be turned upside down. In the case where the structure of the housing 4 is turned upside down, it is also preferable that the projecting direction of the projecting portions 9 and the direction in which the terminals 5 press the flat conductor 3 be opposite to each other. As a result, in the flat conductor 3, the side edge portions 3*d* are curved and deformed by the deformation guiding portions 7 with certainty, and the edges 3*f* of the recesses 3*e* engage the retaining engagement portions 8 with certainty. Therefore, an operation of fitting the flat-conductor connector 1 and the flat conductor 3 to each other is facilitated, and the fitted state between the flat-conductor connector 1 and the flat conductor 3 can be reliably maintained.

In the above embodiment, although a case has been described in which the grooves 13 are linearly and continuously formed from the slot 4*a* of the housing 4 to the positions on the far side in the fitting chamber 4*g*, the grooves 13 may be formed within a range in which the side edge portions 3*d* of the flat conductor 3 are curved and deformed in the lateral direction of the housing 4, that is, within a range in which the projecting portions 9 and the fitting chamber 4*g* are formed.

The flat-conductor connector 1 of the present embodiment is not limited to being applied to the flat conductor 3 having the above-described edges 3*f* of the recesses 3*e*, which serve as the "engagement portions", and can be applied to a flat conductor (FFC or FPC) that has engagement portions included in projecting pieces each projecting from a side edge of the flat conductor so as to have an ear-like shape. In this case, the side edge portions 3*d* of the flat conductor can be determined to be portions of the flat conductor including at least the projecting pieces, each of which projects so as to have an ear-like shape. In addition, the edges of the projecting pieces that are located on the side toward which the flat conductor is to be pulled and that extend in the width direction of the flat conductor function as the "engagement portions" and are to be engaged with the retaining engagement portions 8.

What is claimed is:

1. A flat-conductor connector comprising:

a housing that includes a holding portion into which a flat conductor is inserted such that the flat conductor is electrically connected to the flat-conductor connector, wherein the housing includes a deformation guiding portion that is brought into contact with the flat conductor, which is inserted into the holding portion, and that causes a side edge portion of the flat conductor to be curved and deformed in a plate-thickness direction of the flat conductor and, a retaining engagement portion that is located on a far side of the deformation guiding portion in an insertion direction of the flat conductor and that engages an engagement portion included in the side edge portion of the flat conductor in a direction in which the flat conductor is to be pulled, the side edge portion that has returned from the state of being curved and deformed to an original shape of the side edge portion, wherein the deformation guiding portion has a first inclined surface that is formed so as to extend toward a position on the far side in the insertion direction and so as to come close to a sliding surface that opposes the deformation guiding portion, and wherein the sliding surface has a second inclined surface that is formed at a position adjacent to the first inclined surface in a direction which crosses the insertion direction of the flat conductor and crosses the plate-thickness direction of the flat conductor, so as to extend toward a position on the far side in the insertion direction and so as to come close to the deformation guiding portion.

2. The flat-conductor connector according to claim 1, wherein the housing includes a projecting portion that projects in a direction crossing the insertion direction of the flat conductor from a wall surface partitioning the holding portion, and wherein the projecting portion includes the deformation guiding portion and the retaining engagement portion.

3. The flat-conductor connector according to claim 1, wherein the second inclined surface is formed so as to extend in the insertion direction of the flat conductor and so as to presses the flat conductor toward the deformation guiding portion.

4. The flat-conductor connector according to claim 1, wherein a contact portion of a terminal that is brought into contact with the flat conductor is disposed in the holding portion, and wherein the contact portion is provided at a position different from a position of the deformation guiding portion in the insertion direction.

5. The flat-conductor connector according to claim 1, wherein the holding portion has an opening that is in communication with outside of the housing, and wherein the opening is formed so as to have such a size that a portion of the flat conductor that extends from a front end of the side edge portion of the flat conductor to the engagement portion in the insertion direction is fitted into the opening.

* * * * *